US011933323B2

(12) United States Patent
Torkildsen

(10) Patent No.: US 11,933,323 B2
(45) Date of Patent: Mar. 19, 2024

(54) SHORT IMPELLER FOR A TURBOMACHINE

(71) Applicant: OneSubsea IP UK Limited, London (GB)

(72) Inventor: Bernt-Helge Torkildsen, Bergen (NO)

(73) Assignee: OneSubsea IP UK Limited, London (GB)

( * ) Notice: Subject to any disclaimer, the term of this patent is extended or adjusted under 35 U.S.C. 154(b) by 0 days.

(21) Appl. No.: 15/927,117

(22) Filed: Mar. 21, 2018

(65) Prior Publication Data

US 2018/0223875 A1 Aug. 9, 2018

Related U.S. Application Data

(63) Continuation-in-part of application No. 14/807,531, filed on Jul. 23, 2015, now Pat. No. 10,876,536.
(Continued)

(51) Int. Cl.
*F04D 29/68* (2006.01)
*E21B 43/01* (2006.01)
(Continued)

(52) U.S. Cl.
CPC ..... *F04D 29/68* (2013.01); *E21B 43/01* (2013.01); *E21B 43/121* (2013.01); *F04D 1/06* (2013.01);
(Continued)

(58) Field of Classification Search
CPC .... F04D 29/321; F04D 29/324; F04D 19/007; F04D 19/024; F04D 27/0207; F04D 27/023; F04D 25/0686; F01D 5/142
See application file for complete search history.

(56) References Cited

U.S. PATENT DOCUMENTS 2,019,018 A * 10/1935 Methvin ..... B64C 21/02 244/204
4,483,659 A * 11/1984 Armstrong ..... F01D 5/142 415/181
(Continued)

FOREIGN PATENT DOCUMENTS

CA 1198681 A 12/1985
EP 2824330 A1 1/2015
(Continued)

OTHER PUBLICATIONS

Extended European Search Report issued in European Patent Appl. No. 18163200.1 dated Aug. 1, 2018; 14 pages.
(Continued)

*Primary Examiner* — Woody A Lee, Jr.
*Assistant Examiner* — Justin A Pruitt
(74) *Attorney, Agent, or Firm* — Jeffrey D. Frantz

(57) ABSTRACT

A subsea fluid pressure-increasing machine includes an elongated member that is rotatable about a longitudinal axis. The machine also may include a plurality of impellers each having a leading edge, a trailing edge, a suction side, and a chord line defined by a line between the leading and trailing edges. Each impeller is fixedly mounted to the member such that a chord angle defined by an angle between the chord line and the rotation direction is less than or equal to a stall angle at which a maximum force is exerted on a fluid in a direction primarily parallel to the longitudinal axis when the member is rotated in the rotation direction. At least some of the impellers comprise one or more features that effectively reduce a pressure peak or specific loading of the suction side such that the axial length of the impeller is configured to be reduced without exceeding a desired specific load.

17 Claims, 13 Drawing Sheets

Related U.S. Application Data

(60) Provisional application No. 62/474,413, filed on Mar. 21, 2017.

(51) Int. Cl.

| | |
|---|---|
| ***E21B 43/12*** | (2006.01) |
| ***F04D 1/06*** | (2006.01) |
| ***F04D 13/08*** | (2006.01) |
| ***F04D 29/18*** | (2006.01) |
| ***F04D 29/32*** | (2006.01) |

(52) U.S. Cl.

CPC ..... *F04D 13/086* (2013.01); *F04D 29/185* (2013.01); *F04D 29/321* (2013.01); *F04D 29/324* (2013.01); *F04D 29/682* (2013.01); *F04D 29/684* (2013.01); *F04D 29/688* (2013.01)

(56) References Cited

U.S. PATENT DOCUMENTS

| | | | | |
|---|---|---|---|---|
| 4,721,394 | A | 1/1988 | Casto et al. | |
| 4,840,540 | A | 6/1989 | Kallergis | |
| 6,435,815 | B2 * | 8/2002 | Harvey | F04D 29/682 415/115 |
| 6,488,238 | B1 | 12/2002 | Battisti | |
| 8,016,567 | B2 | 9/2011 | Praisner | |
| 8,449,255 | B2 * | 5/2013 | Tadayon | F16H 1/28 416/37 |
| 8,777,580 | B2 | 7/2014 | Eisenberg | |
| 9,278,753 | B2 | 3/2016 | Reckzeh et al. | |
| 9,476,427 | B2 | 10/2016 | Torkildsen et al. | |
| 2004/0096320 | A1 | 5/2004 | Yevtushenko et al. | |
| 2006/0140760 | A1 * | 6/2006 | Saddoughi | F03D 1/0608 416/23 |
| 2009/0169391 | A1 | 7/2009 | Iida et al. | |
| 2010/0303634 | A1 | 12/2010 | Long | |
| 2011/0229322 | A1 | 9/2011 | Tadayon et al. | |
| 2012/0009065 | A1 * | 1/2012 | Harvey | F01D 5/145 416/91 |
| 2014/0147243 | A1 | 5/2014 | Torkildsen et al. | |
| 2014/0215998 | A1 | 8/2014 | Goswami et al. | |
| 2014/0301860 | A1 * | 10/2014 | Ramm | F01D 5/145 416/231 R |
| 2014/0308130 | A1 * | 10/2014 | Pasetto | F03B 17/067 416/121 |
| 2015/0192105 | A1 * | 7/2015 | Chu | F03D 3/061 416/119 |
| 2016/0052621 | A1 * | 2/2016 | Ireland | F04D 29/681 137/13 |
| 2017/0022967 | A1 * | 1/2017 | Hokelek | F03D 1/0633 |
| 2017/0022994 | A1 | 1/2017 | Torkildsen | |

FOREIGN PATENT DOCUMENTS

| | | | |
|---|---|---|---|
| FR | 982027 | A | 6/1951 |
| WO | 2014083055 | A2 | 6/2014 |

OTHER PUBLICATIONS

Examination Report issued in European Patent Application No. 16726319.3 dated May 25, 2021; 5 pages.

Intent to Grant issued in European Patent Application 18163200.1 dated Feb. 1, 2023, 15 pages.

* cited by examiner

SHORT IMPELLER FOR A TURBOMACHINE

CROSS-REFERENCE TO RELATED APPLICATION

The present document is based on and claims priority to U.S. Provisional Application Ser. No. 62/474,413, filed Mar. 21, 2017, which is incorporated herein by reference in its entirety, and furthermore the present document is a continuation-in-part of U.S. application Ser. No. 14/807,531, filed Jul. 23, 2015.

BACKGROUND

Conventional turbo compressors are designed to compress dry gas. A conventional turbo compressor includes one or more stages. Each stage includes rotating impellers, coupled to a rotating shaft, and static diffusers. To achieve good performance (i.e., large capacity and a high pressure increase with good efficiency), the operating envelope becomes narrow, and a complex control system is used to ensure that the compressor operates within acceptable boundaries and limits. Multi-element airfoils for the impeller blades may be used to enhance the stall characteristics to achieve surge-free operation of the impellers. High cord angles of the impeller blades may lead to large nominal flow rates. Impeller blades arranged with high cord angles may have an increased axial length if the blade chord length is maintained to not increase the specific impeller blade load.

Generally, for multi-phase impellers, the specific blade load is low compared to conventional single-phase impellers to reduce phase separation. Turbomachinery with multi-phase impellers may, therefore, nominally call for a relatively large number of impellers to achieve the desired head. Rotor dynamics, machine size, and weight constraints may limit the maximum number of impeller stages that can be accommodated on a single shaft and, thus, the maximum head that can be achieved. In other words, conventional turbo compressors are designed with low specific loads to avoid phase separation, which consequently limits the maximum head that can be achieved on a single shaft.

SUMMARY

In general, the present disclosure provides a system and methodology involving a subsea fluid pressure increasing machine. According to an embodiment, the pressure increasing machine includes an elongated member rotatable about a longitudinal axis. The machine also may include a plurality of impellers each having a leading edge, a trailing edge and a chord line defined by a line between the leading and trailing edge. Each impeller is fixedly mounted to the first member such that a chord angle, defined by an angle between the chord line and the rotation direction, is less than or equal to a stall angle at which a maximum force is exerted on a fluid in a direction primarily parallel to the longitudinal axis when the member is rotated in the rotation direction. At least some of the impellers comprise one or more features that effectively reduce a pressure peak or specific loading of the suction side such that the axial length of the impeller is configured to be reduced without exceeding a desired specific load.

BRIEF DESCRIPTION OF THE DRAWINGS

Certain embodiments will hereafter be described with reference to the accompanying drawings, wherein like reference numerals denote like elements. It should be understood, however, that the accompanying figures illustrate various implementations described herein and are not meant to limit the scope of various technologies described herein, and.

DETAILED DESCRIPTION

Figure 1:
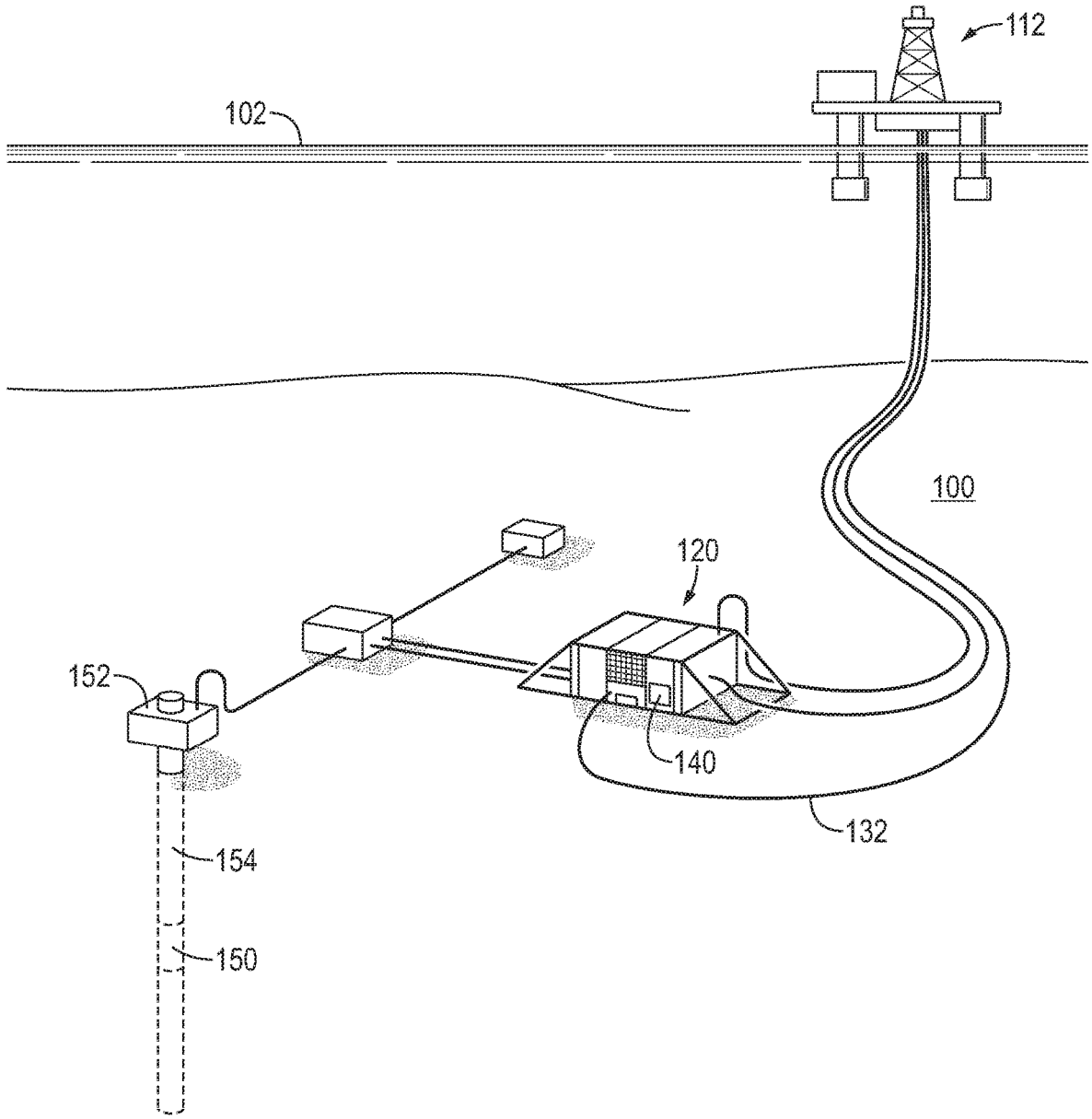
FIG. 1 is a schematic illustration of a subsea environment in which a turbomachine can be deployed, according to an embodiment of the disclosure.

In the following description, numerous details are set forth to provide an understanding of some illustrative embodiments of the present disclosure. However, it will be understood by those of ordinary skill in the art that the system and/or methodology may be practiced without these details and that numerous variations or modifications from the described embodiments may be possible.

The disclosure herein generally relates to a system and methodology involving a subsea fluid pressure increasing machine. The machine includes an elongated member rotatable about a longitudinal axis. A motor system may be mechanically engaged to the member so as to rotate the elongated member about a central longitudinal axis in the rotation direction. The machine also may include a plurality of impellers each having a leading edge, a trailing edge and a chord line defined by a line between the leading and trailing edge. Each impeller is fixedly mounted to the first member such that a chord angle, defined by an angle between the chord line and the rotation direction, is less than or equal to a stall angle at which a maximum force is exerted on a fluid in a direction primarily parallel to the longitudinal axis when the member is rotated in the rotation direction. At least some of the impellers comprise one or more features that effectively reduce a pressure peak or specific loading of the suction side such that the axial length of the impeller is configured to be reduced without exceeding a desired specific load.

According to some embodiments, the machine may be a contra rotating design and includes a second elongated member rotatable about the longitudinal axis in a second rotation direction being opposite to the rotation direction. The machine also may include a second plurality of impellers fixedly mounted to the second member such that the plurality of impellers are interleaved with the second plurality of impellers. Each of the second plurality of impellers also have chord angles that are less than or equal to the respective stall angles.

The fluid processing machine may be of various types. Examples include: gas compressor, wet gas compressor, multiphase compressor, gas pump, liquid pump, multiphase pump, and electric submersible pump (e.g. either on the seafloor or in a wellbore.) According to some embodiments, the machine is free from an anti-surge control system.

A method of imparting force on a fluid also is described herein. The method may include rotating an elongated member about a longitudinal axis in a rotation direction. The elongated member has a plurality of impellers mounted thereto each having a leading edge, a trailing edge and a chord line defined by a line between the leading and trailing edges. Each impeller may be mounted such that a chord angle, defined by an angle between the chord line and the rotation direction, is less than or equal to a stall angle at which a maximum force is exerted on a fluid in a direction primarily parallel to the longitudinal axis.

The fluid processing machine may be a subsea fluid pressure increasing machine. Such a machine may include an elongated member which is rotatable about a longitudinal axis. A motor system may be mechanically engaged to the member so as to rotate the elongated member about a central longitudinal axis in a rotation direction. The machine also includes a plurality of impellers each having one or more gaps or openings that effectively increase a stall angle at which maximum force is exerted on a fluid in a direction primarily parallel to the longitudinal axis when the member is rotated in the rotation direction.

According to some embodiments, the gaps/openings allow fluid from a higher pressure side of the impellers to pass through to a lower pressure side of the impellers. This delays boundary layer separation from the lower pressure side of the impellers. According to some embodiments, each impeller includes a main blade portion and leading slat portion positioned in front of a leading edge of the main blade portion. A gap is formed by the space between the main blade portion and the leading slat portion. According to some embodiments, openings include a combination of holes and a slot(s) positioned in each of the impellers. According to some embodiments, the machine is a wet gas compressor with contra rotating impeller stages.

According to some embodiments, a method includes rotating an elongated member about a longitudinal axis in a rotation direction. The elongated member has a plurality of impellers mounted thereto, each having one or more gaps or openings that effectively increase its stall angle. According to some embodiments, one or more of the described systems and/or methods can be used in topside or subsea fluid processing equipment in an analogous fashion.

Additionally, techniques for achieving a surge-free compressor operation are described that do not rely on an anti-surge control system. Compressor surge occurs when the flow approaches the impeller blades with an incident angle that is so large that the flow is no longer able to stay attached to the low-pressure side of the impeller blade (i.e. the "suction" side of the impeller blade).

According to some embodiments, the impeller blades are positioned such that their chord angles are less than their respective stall angles. If the impeller blades in the compressor meet this condition, then compressor surge does not occur for any positive flow rate. However, the low chord angles to meet the desired surge-free operation can unduly constrain the nominal flow rate for the compressor. The resulting undesirable constraint on flow rate is so great that such designs are often not practical.

Impellers having chord angles less than the stall angles may be used in a contra-rotating impeller arrangement without static diffusers. The contra-rotating impeller arrangement provides for much larger nominal flow rates than conventional single rotating impeller arrangements with the same chord angles. Accordingly, a surge-free design is provided without excessively compromising the nominal flow rate. According to some embodiments, a surge-free compressor includes impellers such that the chord angles of blade airfoils are less than the corresponding airfoils stall angles. By positioning successive impeller stages without static diffusers in a contra rotating arrangement, the nominal flow rate is sufficiently large to justify the low, surge-free chord angle design of the impellers. Thus, a compressor is provided that has reasonable nominal flow rates, is inherently surge-free for positive flow rates, and does not rely on separate surge control systems. Such a compressor is particularly suitable for remote, subsea and multiphase applications. Note that as used herein the term "airfoils" refers to any impeller blade design, regardless of whether the processed fluid is air, another gas, a mixture of gas and liquid, or a liquid.

FIG. 1 is a diagram illustrating a subsea environment in which a surge-free compressor can be deployed, according to some embodiments. On the sea floor 100, a subsea station 120 is shown which is downstream of several wellheads being used, for example, to produce hydrocarbon-bearing fluid from a subterranean rock formation. The station 120 includes a subsea compressor module 140, which is powered by an electric motor, such as an induction motor or permanent magnet motor. According to some embodiments, the compressor module 140 includes a surge-free contra rotating wet gas compressor. The station 120 is connected to one or more umbilical cables, such as umbilical 132. The umbilicals in this case are being run from a platform 112 through seawater 102, along the sea floor 100 and to the station 120. In other cases, the umbilicals may be run from some other surface facility such as a floating production, storage and offloading unit (FPSO), or a shore-based facility. The umbilical 132 can also be used to supply barrier and other fluids, and control and data lines for use with the subsea equipment in the station 120. Although a compressor module 140 is shown in FIG. 1, according to some embodiments the module 140 can be configured for other subsea fluid processing functions, such as a subsea pumping module and/or a subsea separator module. In embodiments described herein, it is understood that references to subsea compressors and compressor modules can refer to subsea pump and pumping modules. Furthermore, references herein to subsea compressors and subsea pumps should be understood to refer equally to subsea compressors and pumps for single phase liquids, single phase gases, or multiphase fluids. According to some embodiments, the surge-free compressor designs described herein are used in connection with an electrical submersible pump (ESP) 150 which can either be located downhole, as shown wellbore 154 in FIG. 1, or it can be located in a subsea location such as on the sea floor in a Christmas tree at a wellhead 152.

Figure 2:
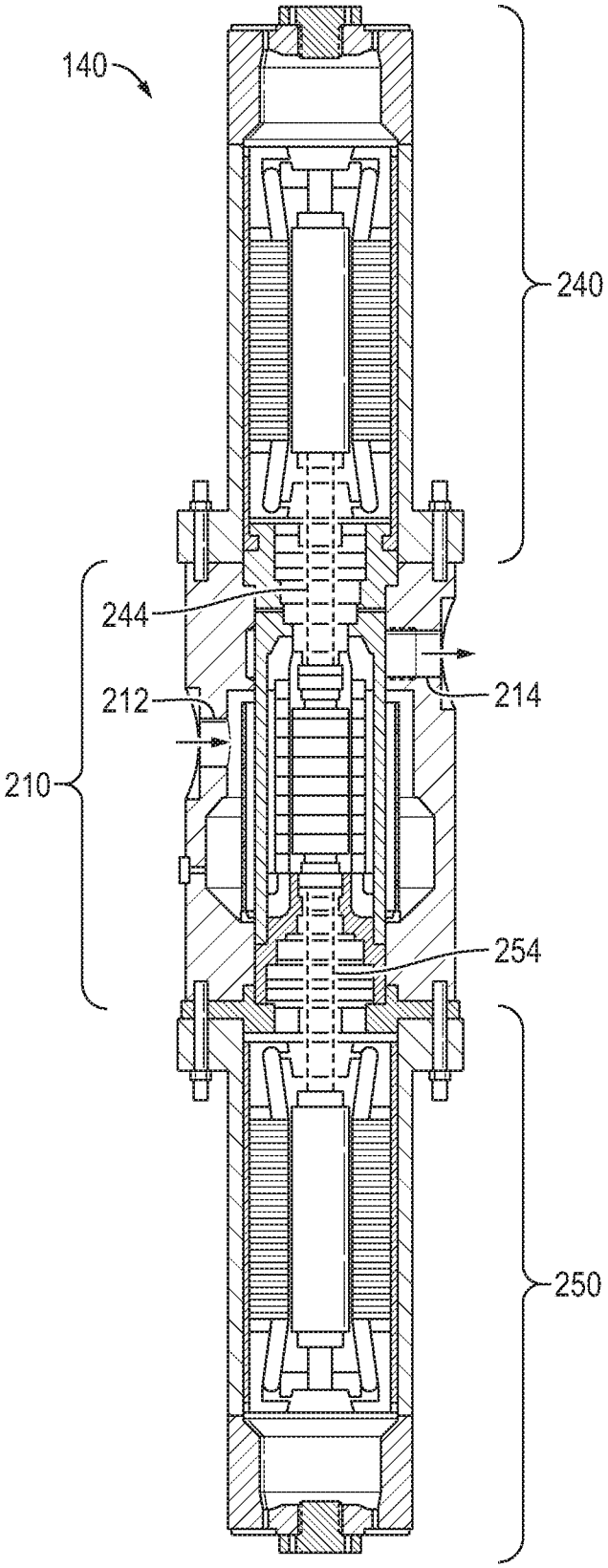
FIG. 2 is a cross-sectional illustration of an example of a turbomachine, according to an embodiment of the disclosure.

FIG. 2 is a cross-sectional view showing further details of a surge-free wet gas compressor, according to some embodiments. The compressor module 140 includes an upper motor 240, a lower motor 250, and a contra rotating compressor section 210. The lower motor 250 drives a lower shaft 254 that rotates an inner hub within the compressor section 210 on which impellers are fixed. Likewise, the upper motor 240 drives an upper shaft 244 that rotates an outer sleeve within the compressor section 210 on which impellers are fixed. Notably, the rotation direction of the upper and lower shafts 244 and 254 are opposite to one another. The compressor section 210 has an inlet 212 and outlet 214. The compressor section 210 has interleaved rows of impellers mounted to the inner hub and outer sleeve that are stacked successively to each other and rotate in opposite directions.

Figure 3A:
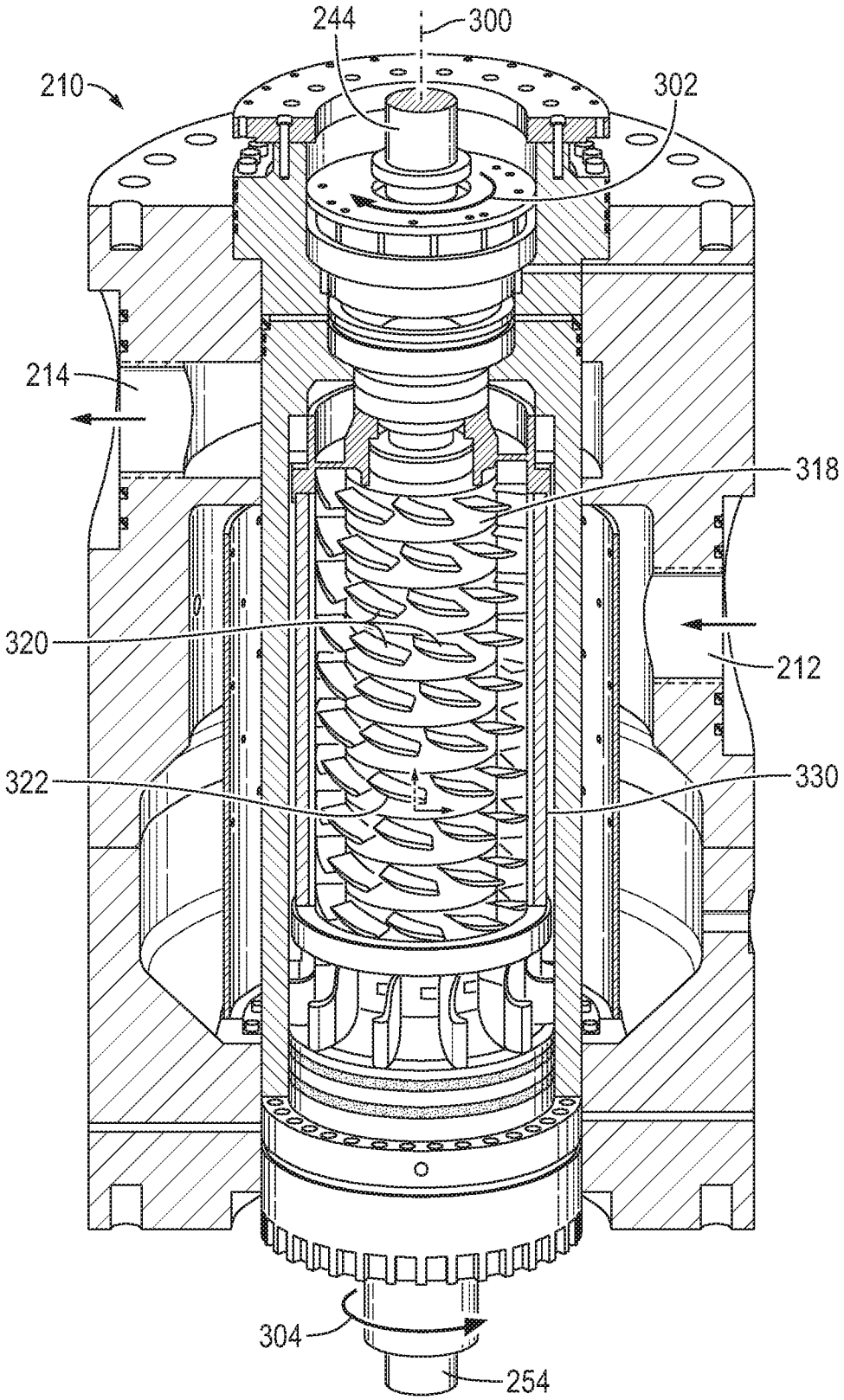
FIG. 3A is a cutaway illustration of an example of a turbomachine, according to an embodiment of the disclosure.
Figure 3B:
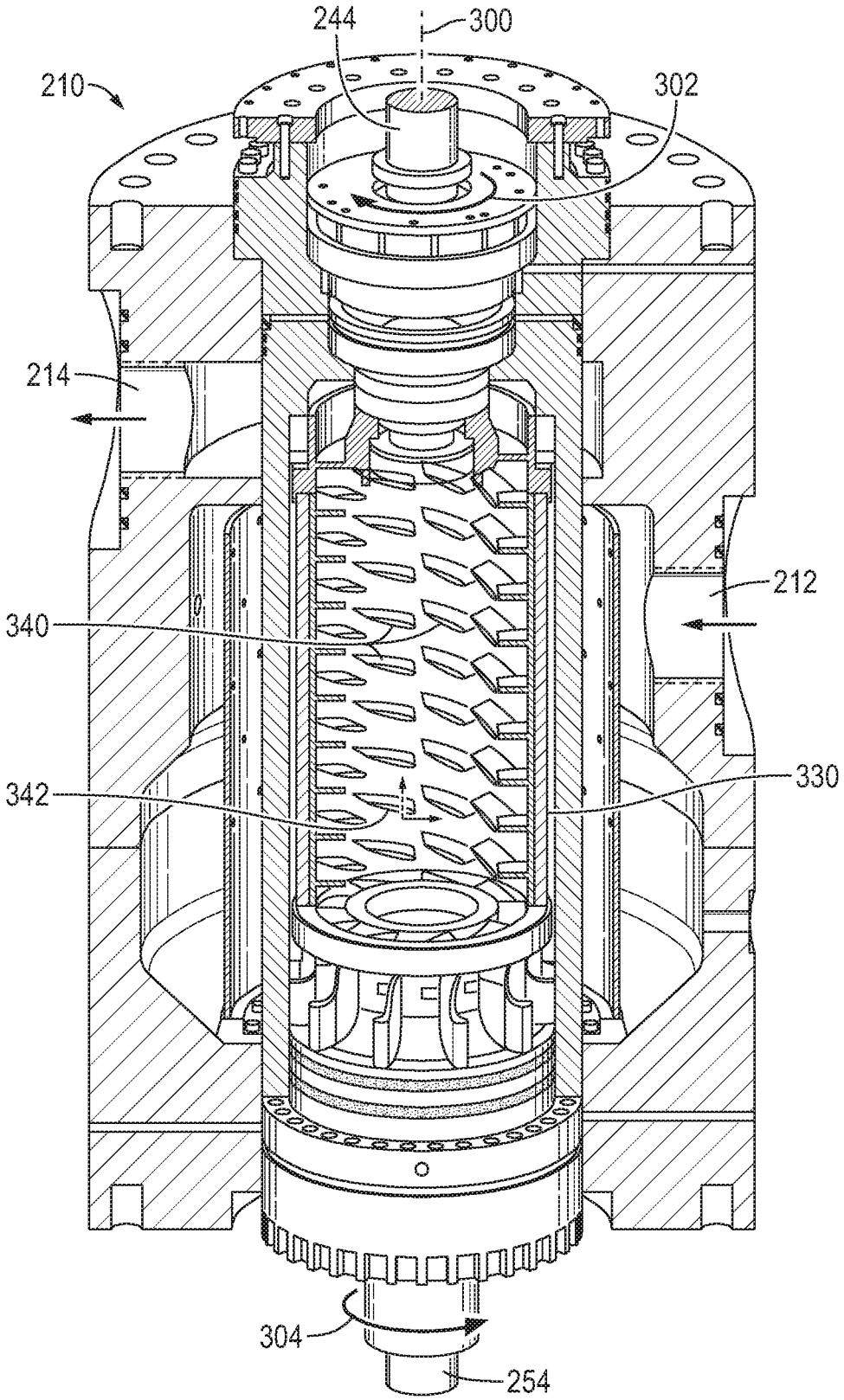
FIG. 3B is a cutaway illustration similar to that of FIG. 3A and showing an example of a turbomachine, according to an embodiment of the disclosure.

FIGS. 3A and 3B are perspective cut away views of portions of a surge-free contra rotating compressor, according to some embodiments. In FIG. 3A, the fluid enters the compressor section 210 via the inlet 212. The fluid then passes around and/or through a perforated wall and through a manifold such that it enters the impeller section from the bottom. The alternating rows of impellers are driven in opposite directions and together urge the fluid upwards, thus compressing the fluid to higher and higher pressures as it moves upwards. The compressed fluid exits the compressor section 210 via the outlet 214. Also visible in FIG. 3A is a lower shaft 254 that rotates about the central axis 300 in the direction shown by solid arrow 304. The lower shaft 254 drives an inner hub 318 on which the impellers 320 are fixedly mounted in distinct rows. Also visible is an impeller 322 that is being driven in the direction shown by the solid arrow and is shaped so as to urge fluid in an upwards direction shown by the dotted arrow. An outer sleeve 330 is also shown which is driven by the upper shaft 244 in the direction shown by solid arrow 302.

In FIG. 3B, the upper shaft 244 is shown rotating about the central axis 300 in the direction shown by solid arrow 302. Also visible are impellers 340 mounted on the outer sleeve 330 as shown in distinct rows. Also visible is an impeller 342 that is being driven in the direction shown by the solid arrow and is shaped so as to urge fluid in an upwards direction shown by the dotted arrow. Through the use of interleaved rows of impellers mounted to the inner hub 318 and the outer sleeve 330 that are stacked successively to each other and rotate in opposite directions, each row of impellers effectively forms a separate stage of the compressor. Note that in this design there are no guide vanes or diffusers between the successive adjacent stages. Rather, the fluid discharged from a stage rotating in one direction immediately enters into the stage rotating in the opposite direction and so on through a number of successive contra rotating stages.

Figure 4:
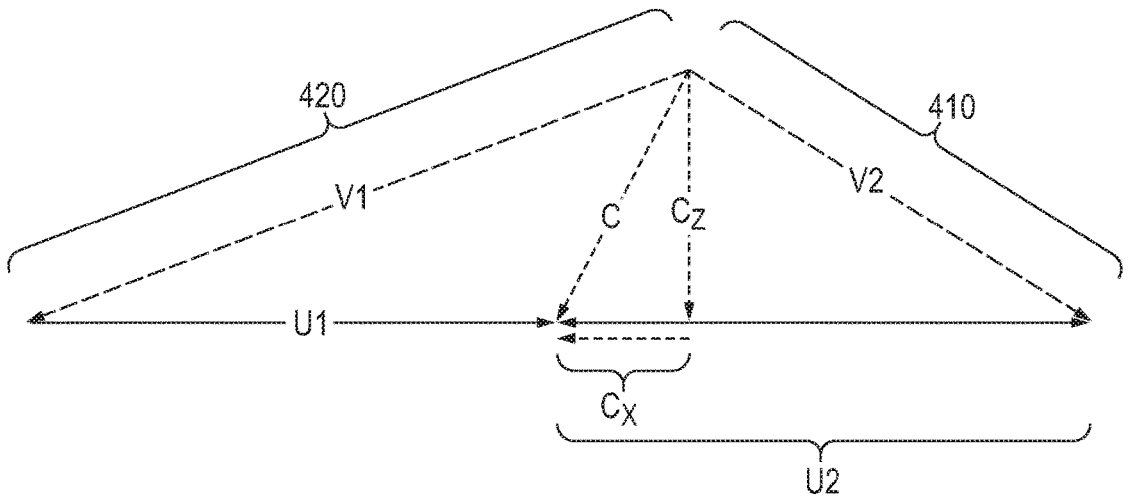
FIG. 4 is a diagrammatic illustration showing velocity angles for an impeller in a turbomachine, according to an embodiment of the disclosure.

FIG. 4 is a diagram showing velocity triangles for successive impeller stages in a contra-rotating compressor, according to some embodiments. Shown are the outlet velocity triangle 410 for one impeller, and the impeller inlet velocity triangle 420 for a successive contra-rotating impeller. Vector U (U1 for inlet and U2 for outlet) represents rotating velocity for the impellers, vectors V1 and V2 represent process flow velocity relative to the impellers, and vectors C1 and C2 represent the absolute fluid flow velocity such that: C=U+V. Note that the velocity triangles 410 and 420 are simplified for the purpose of illustration.

Figure 5:
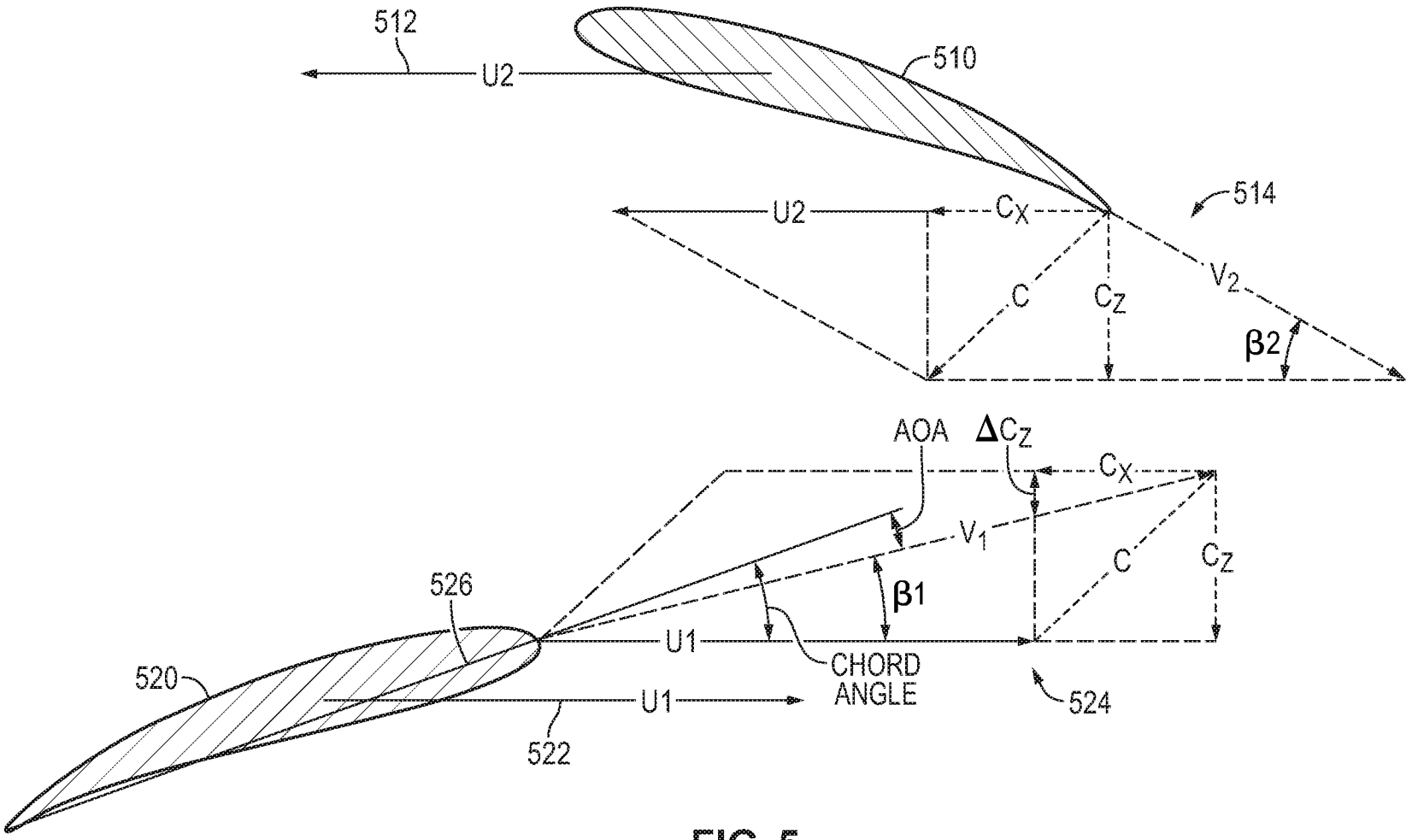
FIG. 5 is a diagrammatic illustration showing velocity vectors for two successive country-rotating impeller blade airfoils, according to an embodiment of the disclosure.

FIG. 5 is a diagram showing velocity vectors for two successive contra-rotating impeller blade airfoils, according to some embodiments. Note that the axial spacing between impellers 510 and 520 has been exaggerated in order to give room for the illustrating velocity vector triangles. The outlet velocity vector 512 and the velocity triangle 514 are shown for the outlet of impeller 510, and the inlet velocity vector 522 and velocity triangle 524 are shown for inlet of impeller 520. Referring to the inlet velocity triangle 524 with the understanding that the flow rate is proportional to Cz, it can be observed that the maximum incident angle or angle of attack (AOA) possible for positive flow rates, occurs when the flow rate nears zero where AOA equals the blade airfoil chord angle. Note the chord angle is defined by chord line 526 which is drawn between the leading and trailing edges of the impeller. By designing the impellers such that the chord angles of blade airfoils are less than the corresponding airfoils stall angles, surge cannot occur for any positive flow rate.

From FIG. 5 the following equation can be derived:

$$Cz=(U-Cx)\cdot\tan(\beta 1),$$

where Cx is negative for contra rotating impellers. The nominal flow rate can be defined at a zero incident angle, i.e., when V1 is tangential to the airfoil leading edge camber line, which for a cambered airfoil normally results in a small AOA with β1 close to the airfoil chord angle. As the nominal flow rate is proportional to Cz, it can be observed from the above equation that the nominal flow rate increase with increasing magnitude of Cx for contra rotating impellers since Cx then is negative. In comparison, for a conventional single rotating impeller arrangement with static diffusers, Cx will ideally be zero but normally has a small positive.

The relative increase in flow rate for a contra-rotating impeller arrangement compared to an ideal single rotating impeller arrangement with static diffusers with the same impeller chord angles becomes:

$$\Delta Q\text{nom}/Q\text{nom}=-Cx/U>0;\ \text{for negative } Cx.$$

Thus, according to some embodiments, the use of contra-rotating impeller stages allows for higher nominal flow rates which makes the surge-free condition (each of the impellers has its chord angle less than or equal to its stall angle) practical, especially for applications such as subsea deployments and/or wet gas compressors. Note that impellers 510 and 520 are shown to be arranged such that they force fluid downwards so as to be more understandable to those familiar with the concept of aerodynamic lift. According to some embodiments, however, such as shown in FIGS. 2, 3A and 3B, the impellers are inverted such that the fluid is forced in an upwards direction.

According to some embodiments, the impeller blades are cylindrical (i.e., its shape does not change along the radial direction). In such cases the chord line can simply be drawn between the leading and trailing edges of the impeller. In some embodiments, however, the impeller blade is non-cylindrical in that its shape changes in the radial direction. In such cases a mean cord line is defined and can be used for calculating the chord angle. Examples of non-cylindrical shapes include slight changes in chord angle to accommodate the fact that locations of the impeller further from the central axis "see" a slightly higher fluid velocity. Other examples include impellers having elements to enhance stall characteristics such as slots which may not run the whole width of the impeller. Examples are shown in FIGS. 12A-12D, infra.

Figure 6:
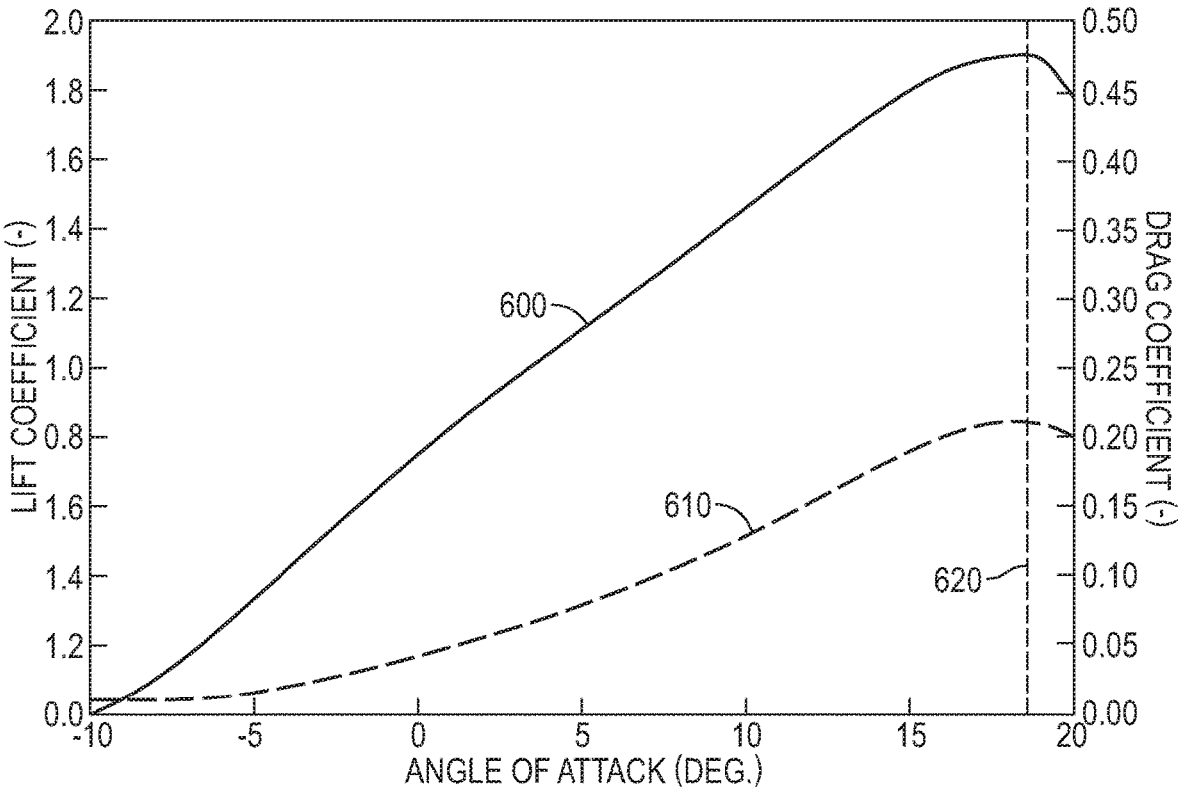
FIG. 6 is a plot showing the lift and drag coefficients for an example of an impeller, according to an embodiment of the disclosure.

FIG. 6 is a plot showing lift and drag coefficients for a typical impeller, according to some embodiments. In the plot, the curve 600 represents the lift coefficient at various angles of attack while the curve 610 represents the drag coefficient at various angles of attack. The stall angle 620 is also shown. The stall occurs when the flow approaches the impeller blades with an incident angle so large that it is no longer able to stay attached to the suction side of the impeller blade. As explained above, the maximum incident angle for the compressor impeller that is possible for positive flow rates occur for zero flow rate when the angles of attack equal the corresponding blade airfoil chord angles. By designing the impellers such that the chord angles of blade airfoils are less than the corresponding airfoils stall angles, surge cannot occur for positive flow rates.

According to some embodiments, impeller blades having enhanced stall characteristics are provided. In particular, by increasing the stall angle of the impellers blades, a surge-free design is practical without excessively compromising the nominal flow rate. Increasing the stall angle of impeller blades can be accomplished in a number of ways, some illustrative examples of which are described herein.

In general, impeller blades and airfoils that are designed for high maximum lift will also have high stall angles. A number of different impeller blade/airfoil designs and design features are available for this purpose. According to some embodiments, further increase in the impeller blade/airfoil stall angle is achieved by introducing a slot arrangement near the leading edge of the impeller blade/airfoil. According to some other embodiments, an increase in the impeller blade/airfoil stall angle is accomplished by using multiple elements for each impeller blade/airfoil. By applying impeller blade/airfoils with increased stall angles, the nominal flow rate of the compressor can be made sufficiently large so as to justify surge-free chord angle positioning of the impellers.

Figure 7:
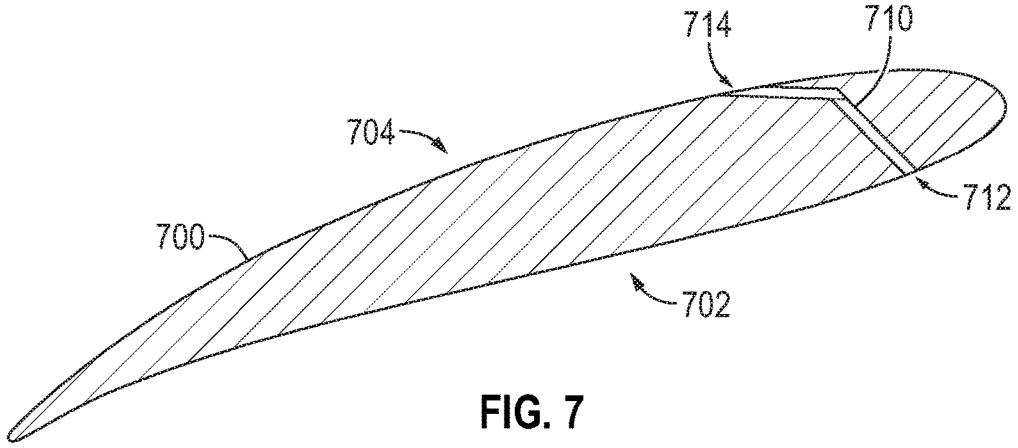
FIG. 7 is a cross-sectional illustration of an impeller blade having enhanced stall characteristics, according to an embodiment of the disclosure.

FIG. 7 is a cross-sectional diagram of an impeller blade having enhanced stall characteristics, according to some embodiments. An impeller blade 700 is shown having a high pressure side 702 and a low pressure side 704. The impeller blade 700 includes a conduit 710 that has an inlet 712 on the high pressure side 702 and an outlet 714 on the low pressure side 704. According to some embodiments, the conduit 710 is a simple circular orifice through the impeller blade 700. According to other embodiments, the conduit 710 is slot shaped and spans a significant width of the impeller blade 700. According to some yet other embodiments, the conduit shapes are more complex. In some embodiments, for example, the lower portion of the conduit 710 (i.e., nearer to the inlet 712) is a circular orifice and the upper portion of the conduit 710 (i.e., near to the outlet 714) is a slot that opens to multiple other orifices that are not visible in FIG. 7.

Figure 8A:
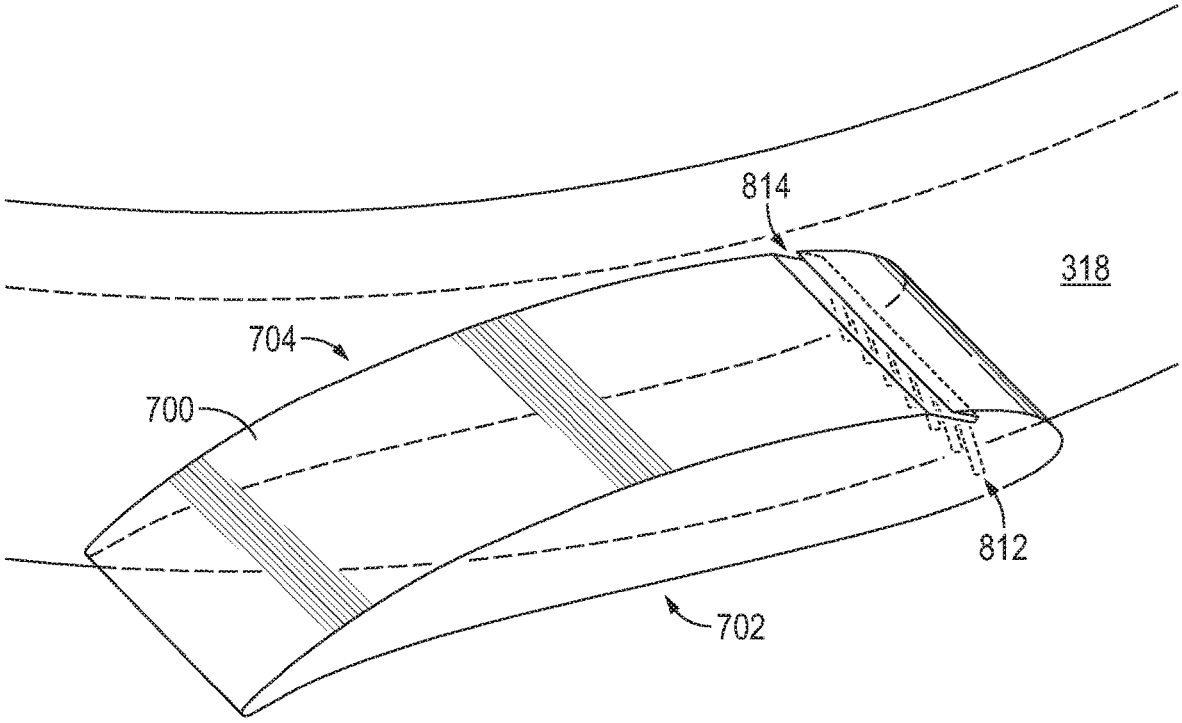
FIG. 8A is a diagram illustrating aspects of an impeller blade having enhanced stall characteristics, according to an embodiment of the disclosure.
Figure 8B:
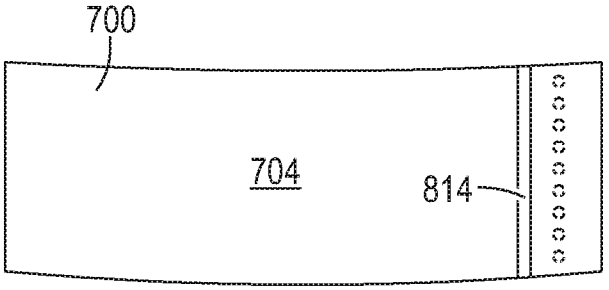
FIG. 8B is another diagram illustrating aspects of an impeller blade having enhanced stall characteristics, according to an embodiment of the disclosure.
Figure 8C:
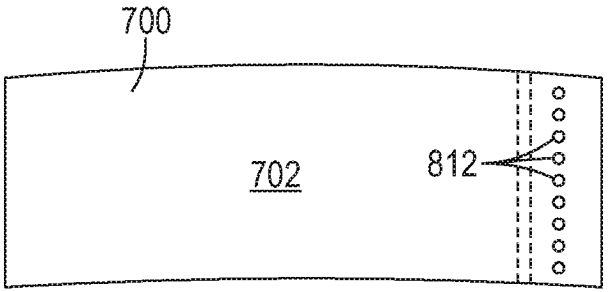
FIG. 8C is another diagram illustrating aspects of an impeller blade having enhanced stall characteristics, according to an embodiment of the disclosure.

FIGS. 8A, 8B and 8C are diagrams illustrating further aspects of an impeller blade having enhanced stall characteristics, according to some embodiments. FIG. 8A is a perspective view of the impeller blade 700. In this case, the impeller blade 700 is cylindrical in shape and is shown mounted to an exterior surface of inner hub 318 (also shown in FIGS. 3A and 3B). Also visible are multiple orifices 812 that lead from the higher pressure side 702 to a slot 814 that extends to the lower pressure side 704. Note the orifices 812 each have an inlet on the higher pressure side 702 that corresponds to the inlet 712 in FIG. 8A, and slot 814 has an outlet on the lower pressure side 704 that corresponds to the outlet 714. FIGS. 8B and 8C are top and bottom views of impeller blade 700.

According to some embodiments, the orifices 812 are circular holes with diameters of about 2% of the airfoil chord length are distributed along a straight line from hub 318 to tip on the high pressure side 702 of the impeller blade 700 at the approximate location of the stagnation point for incipient boundary layer separation at a high angle of attack. According to some embodiments, the holes 812 penetrate about 75% of the impeller blade thickness before they are manifolded in a slot 814 pointing out and backwards on the suction side 704 of the impeller blade 700 with an angle of approximately 20 degrees to the impeller blade surface and located upstream of location of incipient boundary layer separation at a high angle of attack.

The pressure difference between the high pressure side 702 and suction (or low pressure) side 704 of the impeller blade will cause a positive flow from the high pressure side 702 through the holes 812 and the slot 814 to the suction side 704 of the impeller blade, thereby helping to delay boundary layer separation.

Figure 9:
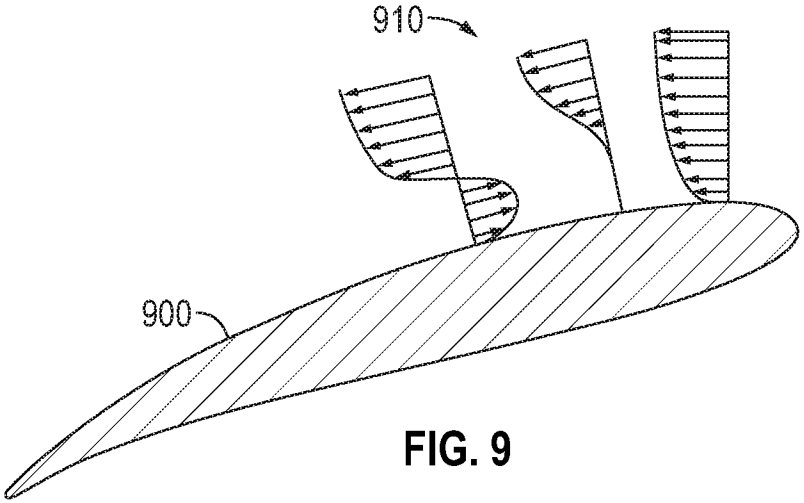
FIG. 9 is an illustration showing an impeller blade without additional stall angle increasing enhancements, according to an embodiment of the disclosure.
Figure 10:
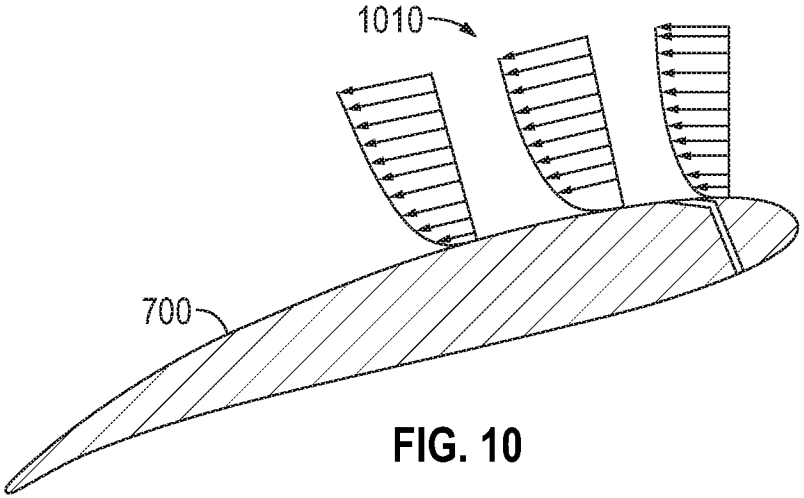
FIG. 10 is an illustration showing an impeller blade with additional stall angle increasing enhancements, according to an embodiment of the disclosure.

FIG. 9 shows an impeller blade without additional stall angle increasing enhancements. As can be seen by the aerodynamic indicators 910, significant boundary layer separation exists at the chord angle shown on un-enhanced impeller blade 900. FIG. 10 shows an impeller blade with additional stall angle increasing enhancements, according to some embodiments. The impeller blade 700 has orifices that allow fluid to pass from the higher pressure side to the lower pressure side. As can be seen by the aerodynamic indicators 1010, the orifices are effective in preventing boundary layer separation when enhanced impeller blade 700 is at the same chord angle as unenhanced impeller blade 900 in FIG. 9.

Figure 11:
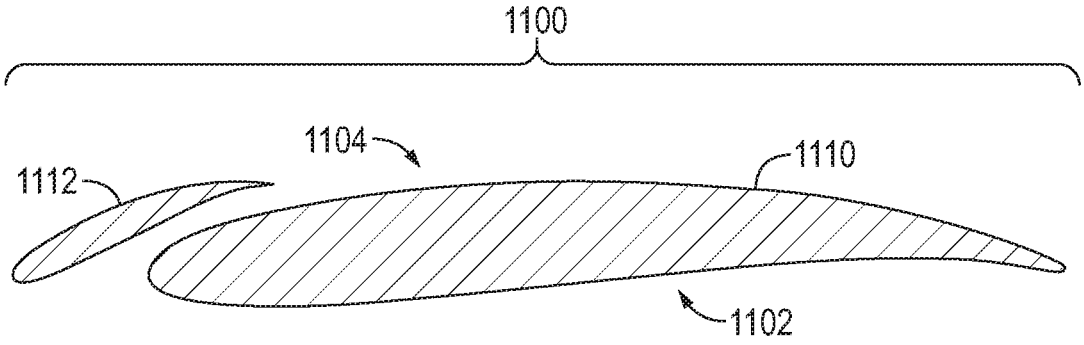
FIG. 11 is a cross-sectional illustration showing an example of the multi-element impeller blade, according to an embodiment of the disclosure.

FIG. 11 is a cross-sectional view showing an example of a multi-element impeller blade, according to some embodiments. The impeller 1100 is shown made up of two elements: a main impeller blade 1110 and a fixed slat 1112. The gap between the main blade 1110 and the slat 1112 allows fluid to pass from the high pressure side 1102 to the low pressure side 1104, which delays boundary layer separation and increases the effective stall angle of impeller 1100. Various multi-element airfoil gap effects are known, including: slat-effect; circulation effect; dumping effect; off-the-surface pressure recovery effect; and fresh-boundary-layer effect. According to some embodiments, one or more of these effects are used in fluid compressors to delay boundary layer separation and increase impeller blade maximum "lift."

By using one or more stall angle enhancement techniques such as orifices, slots, slats, and gaps, the stall angle of the compressor impellers can be increased. Increasing the stall angles of the impellers allows for larger impeller chord angles and higher nominal flow rates while still maintaining surge-free performance without reliance on anti-surge systems. According to some embodiments, the stall angle enhancements described increase nominal flow rates enough that simple rotation (i.e., non-contra rotating) compressor designs can be used. According to some other embodiments, the stall angle enhancements described are used in combination with a contra rotating arrangement to even further boost surge-free nominal flow rates over what would be achievable without such enhancements.

Figure 12A:
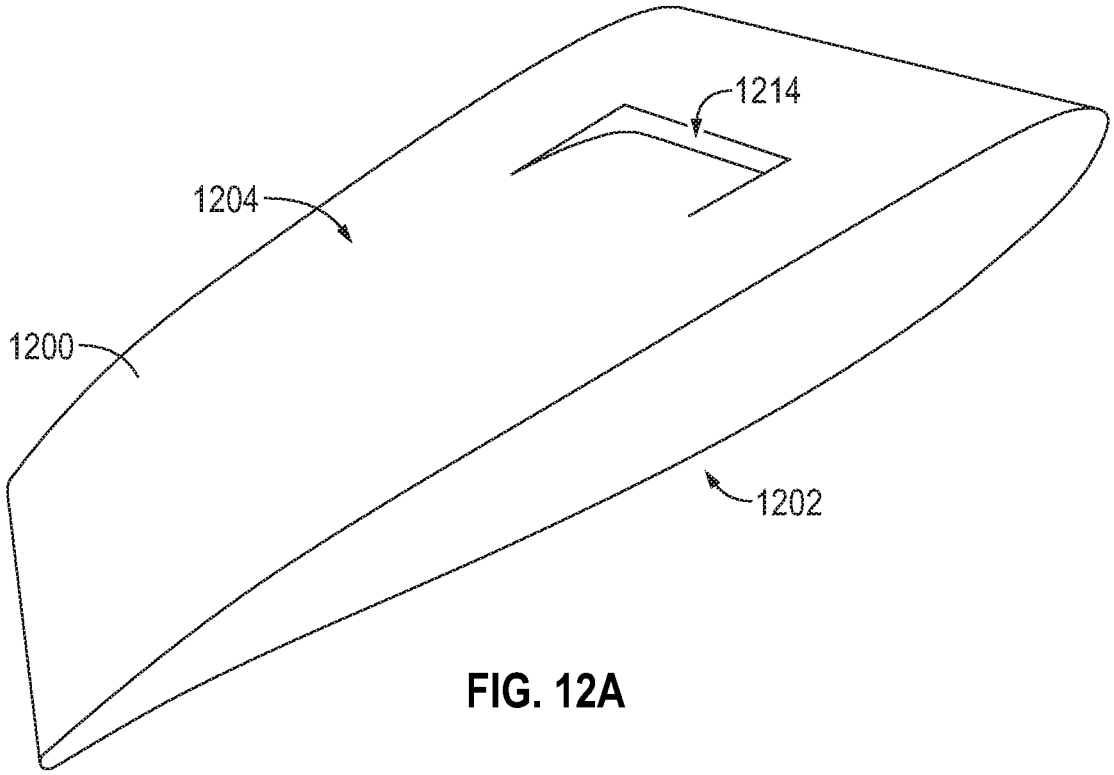
FIG. 12A is an illustration of an example of a slotted impeller blade, according to an embodiment of the disclosure.
Figure 12B:
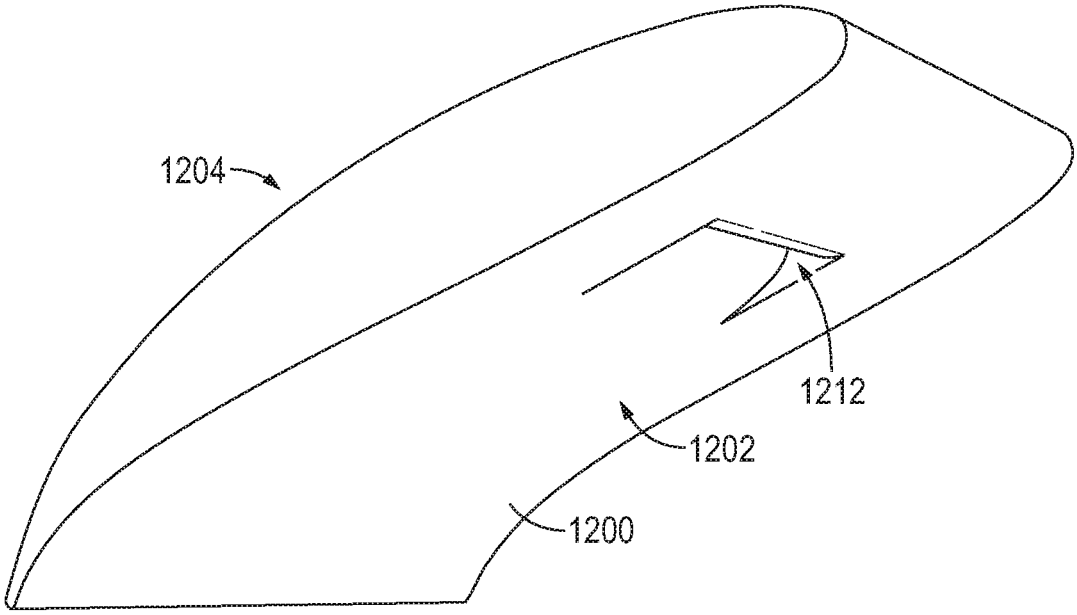
FIG. 12B is another illustration of an example of a slotted impeller blade, according to an embodiment of the disclosure.
Figure 12C:
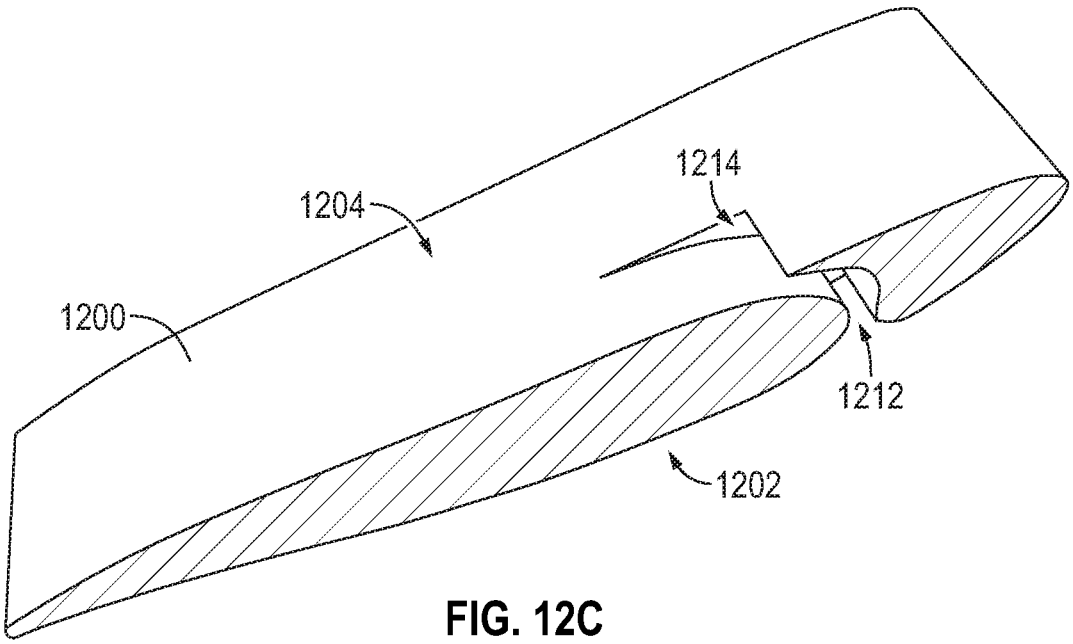
FIG. 12C is another illustration of an example of a slotted impeller blade, according to an embodiment of the disclosure.
Figure 12D:
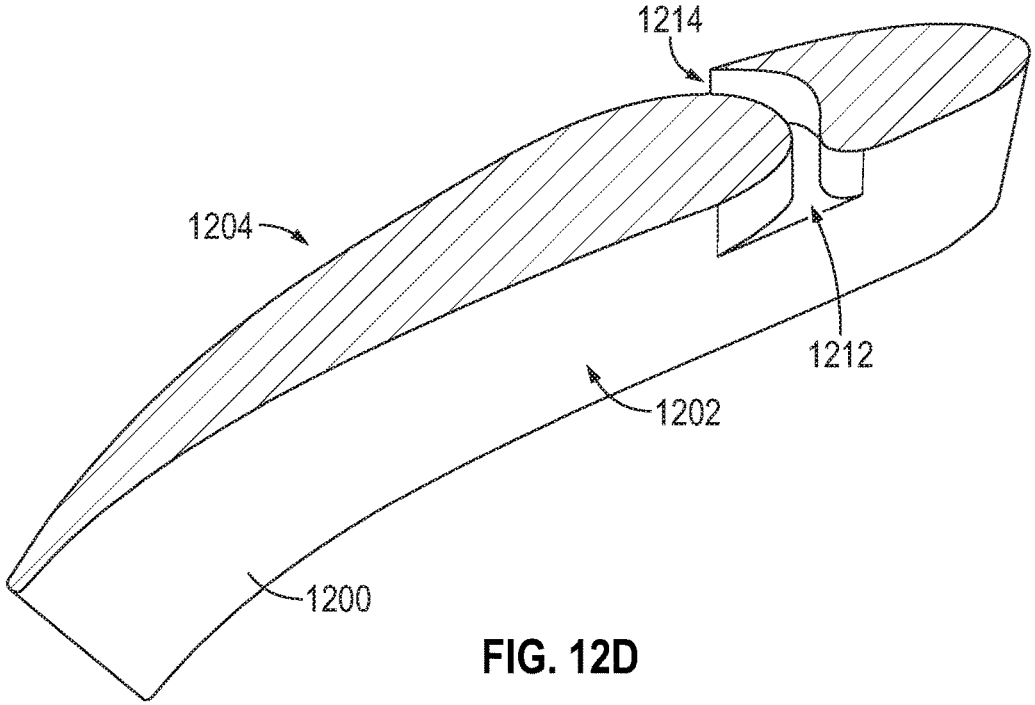
FIG. 12D is another illustration of an example of a slotted impeller blade, according to an embodiment of the disclosure.

FIGS. 12A-12D are perspective and sectional perspective views showing examples of a slotted impeller blade, according to some embodiments. The impeller blade 1200 in this case has a large slot having a high pressure opening 1212 on the higher pressure side 1202 and a low-pressure opening 1214 on the lower pressure side 1204. FIGS. 12C and 12D are sectional perspective views that show details of the shape of the central slot. The slot allows fluid to pass from the high pressure side 1202 to the low pressure side 1204, which delays boundary layer separation and increases the effective stall angle of impeller 1200. According to some other embodiments, the slot is not in the center of the impeller as shown in FIGS. 12A and 12B. Rather in some cases the slot can be provided closer to the hub or sleeve wall. FIGS. 12C and/or 12D also can represent such embodiments. In other embodiments, the slot can be provided closer to the either the leading or trailing edge of the impeller. In yet other embodiments multiple slots can be located at various positions relative to the hub or sleeve wall and/or leading or trailing edge.

Figure 13A:
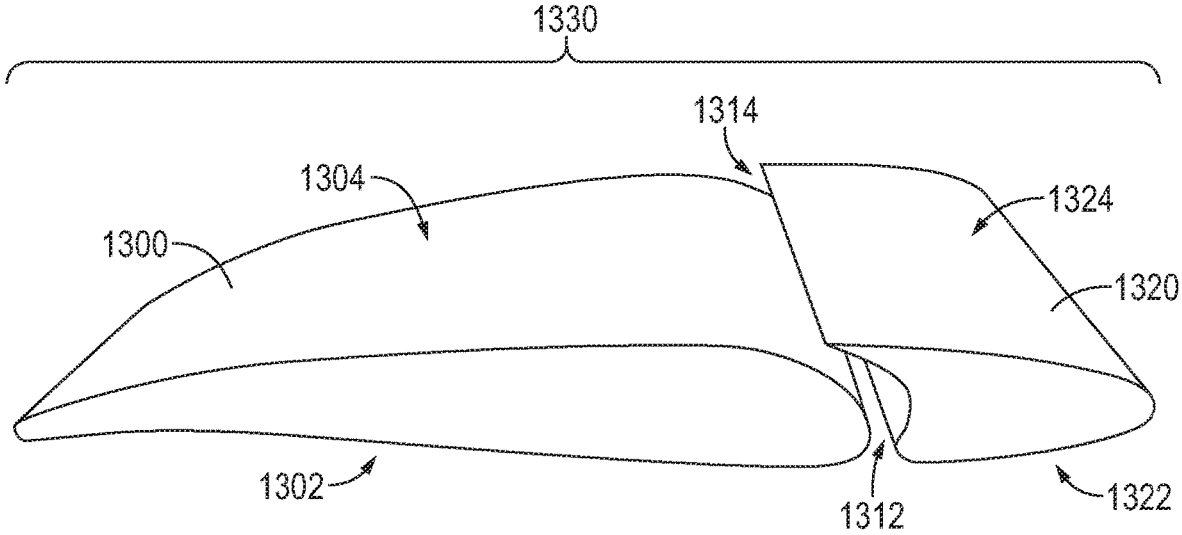
FIG. 13A is an illustration showing a perspective view of an example of a multi-element impeller blade, according to an embodiment of the disclosure.
Figure 13B:
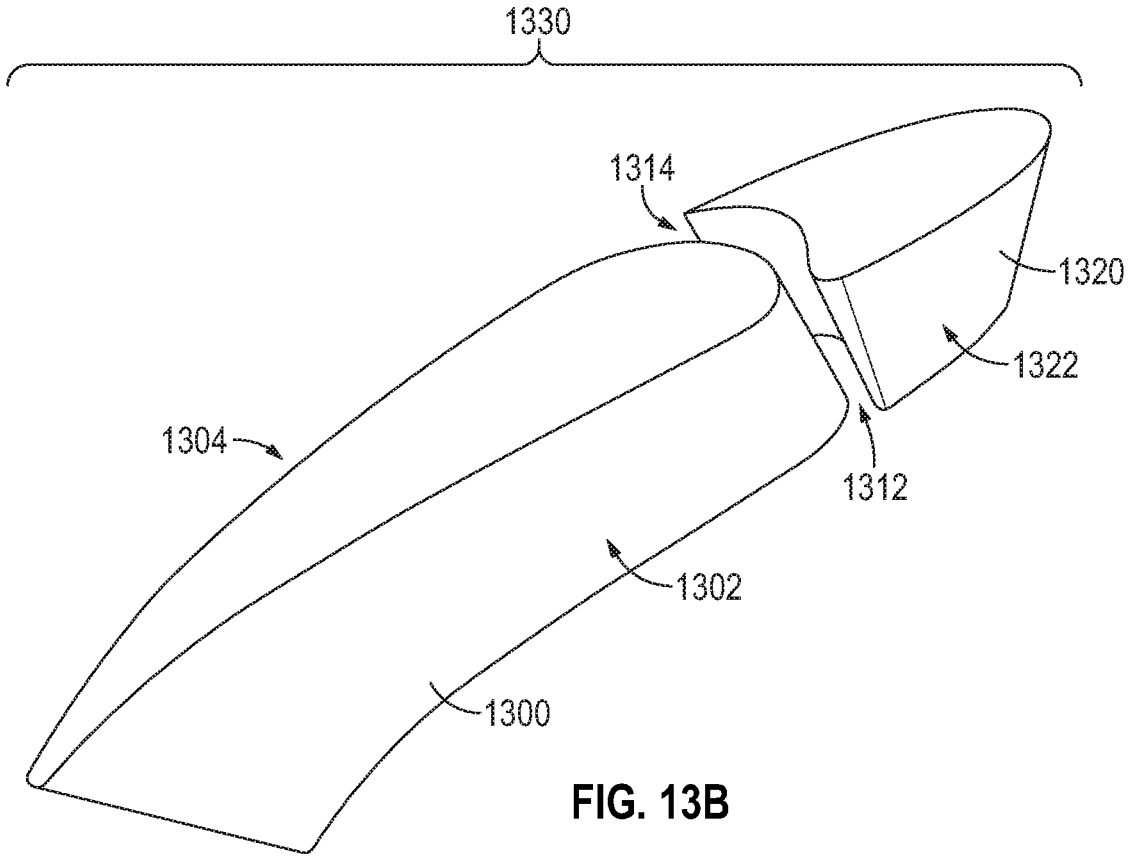
FIG. 13B is an illustration showing another perspective view of an example of a multi-element impeller blade, according to an embodiment of the disclosure.
Figure 13C:
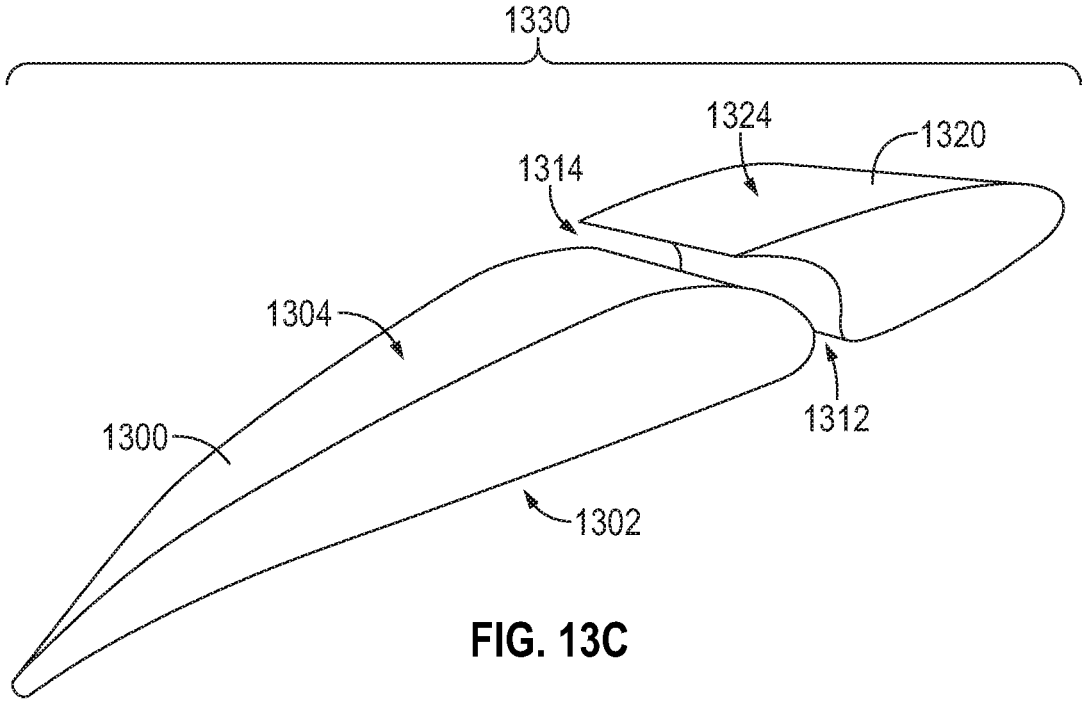
FIG. 13C is an illustration showing another perspective view of an example of a multi-element impeller blade, according to an embodiment of the disclosure.

FIGS. 13A-13C are perspective views showing examples of a multi-element impeller blade, according to some embodiments. The impeller 1330 is similar in design to that shown in FIG. 11, and includes a trailing element 1300 and a leading element 1320 with a slot formed therebetween. The trailing element 1300 includes a lower pressure side 1304 and a higher pressure side 1302. Similarly, the leading element 1320 includes a lower pressure side 1324 and a higher pressure side 1322. The slot formed between the leading and trailing element includes a higher pressure inlet 1312 and a lower pressure outlet 1314. The gap between the trailing element 1300 and leading element 1320 allows fluid to pass from the higher pressure side of impeller 1330 to the lower pressure side, which delays boundary layer separation and increases the effective stall angle of impeller 1330.

Figure 14:
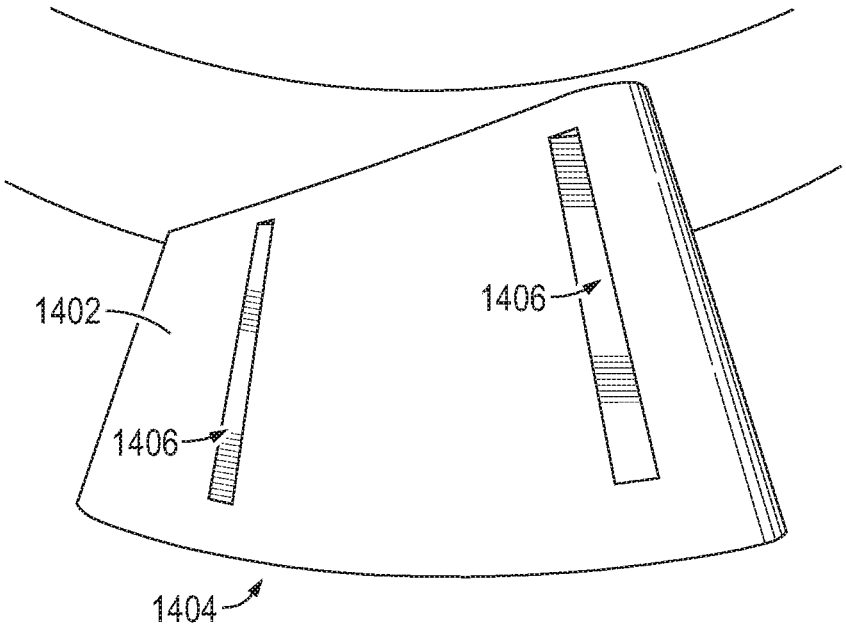
FIG. 14 is an illustration showing a top view of an example of a slotted impeller blade, according to an embodiment of the disclosure.

FIG. 14 is a top view showing an example of an impeller 1400 having a slotted impeller blade 1402, according to some embodiments. The systems and methods disclosed herein may reduce the specific blade-load on multi-phase impellers 1400 such that the axial length of the impellers 1400 can be reduced. This may allow a single shaft to carry more impellers 1400. As a result, the overall or total machine head capability can be increased. By designing the impeller blade airfoils 1404 with arrangements of slots or other suitable features 1406 on the slotted impeller blade 1402, or by multi-element airfoils, the specific load on the impeller blades 1402 may be reduced.

Depending on the embodiment, at least some of the impellers 1400 in a given fluid pressure increasing machine comprise one or more slots/features 1406 that effectively reduce a pressure peak or specific loading of the suction side of blades 1402 such that the axial length of the impeller 1400 is configured to be reduced without exceeding a desired specific load. It should be noted the slots 1406 may be in the form of openings, e.g. recesses, but they also may be in the form of suitable ridges or other features in some applications. In the example illustrated, slots 1406 are arranged radially along blades 1402 to extend outwardly from a hub of the impeller 1400 toward radially outlying tips of the impeller blades 1402.

As a result, the blade chord length can be reduced without exceeding the maximum specific load that the operation and design dictates. The systems and methods disclosed herein allow for a reduction in the impeller blade chord length and correspondingly in the impeller blade axial length. This allows more impellers to be placed/fit on a single shaft for similar and/or comparable rotor dynamics, machine size, and weight constraints. By increasing the number of stages on a single shaft, the maximum overall or total head of the machine can be increased.

Impeller blade slot arrangements 1406 or multi-element airfoils have the effect of reducing the suction peak of the impeller blades or airfoils and, at the same time, increasing the "dump" velocity of the boundary layer of the impeller blades 1402. These effects will lower the specific load on the impeller blades 1402.

Because of slots 1406, the specific blade load is reduced and thus the impeller blades 1402 may be constructed with shorter blade chords without exceeding the desired specific blade load. The specific blade load is expressed as (dp/ds) which is the pressure gradient along a streamline through the impeller 1400. The (dp/ds) is reduced as a result of the slots 1406 even though the (dp/ds) normally increases as the blade chord length is reduced.

Figure 15:
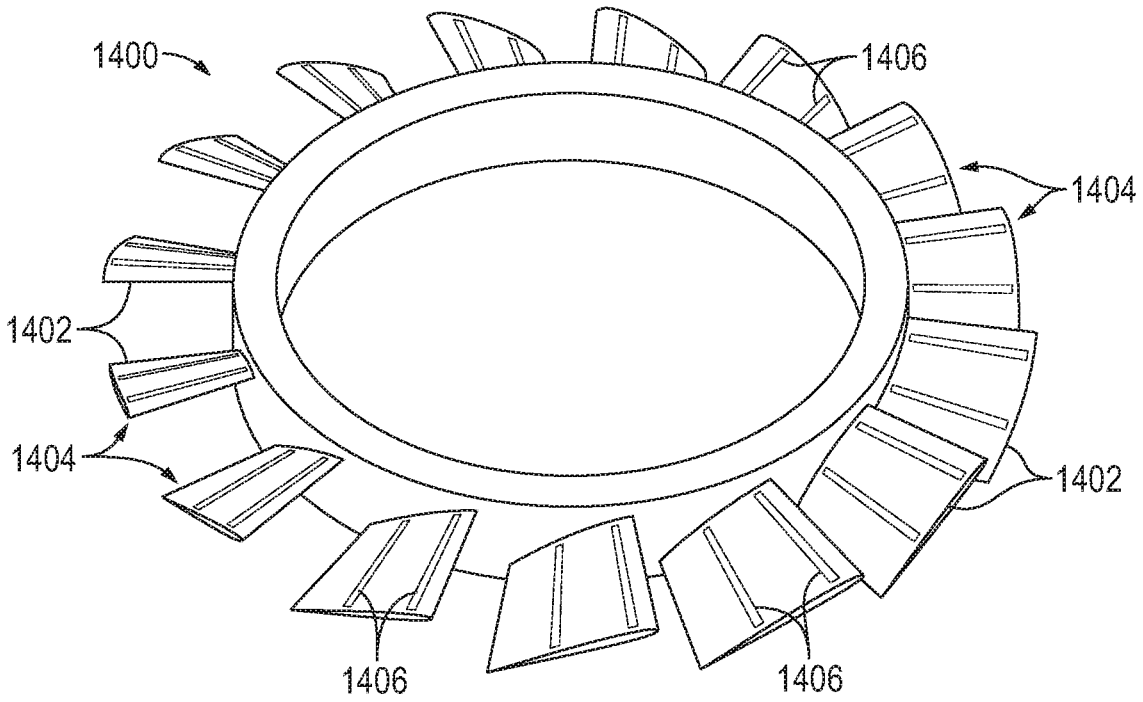
FIG. 15 is an illustration showing a perspective view of an example of an impeller with shorter blade chord lengths and a reduced specific blade load, according to an embodiment of the disclosure.

Referring generally to FIG. 15, an example of impeller 1400 is illustrated as having a shorter axial length (impeller height) due to the ability to form impeller blades 1402 with a reduced blade chord length resulting from incorporation of slots 1406. To compensate for the shorter blade chord length, the number of impeller blades 1402 has been increased. In this embodiment, however, the (blade chord length)×(number of blades) is the same for the axially shorter impeller with the greater number of blades as compared to a traditional/reference impeller having, for example, 9 blades with greater axial length and greater blade chord length. Hence, in accordance with classic impeller cascade theory for dry gas, the two impellers have the same performance.

The axial length (Laxial) of impeller 1400 equals the impeller blade chord length (Lchord) times sinus to the blade profile chord angle (beta) plus a small clearance to the next impeller (C). The clearance is a fraction and may be represented as:

$$c=C/L\text{chord}.$$

The impeller axial length can therefore be expressed as:

$$L\text{axial}=L\text{chord}\times(\sin(\text{beta})+c).$$

Introduction of the impeller blade slots 1406 results in a reduced specific load such that the impeller blade chord length can be reduced to, for example, 60% of the chord length of an un-slotted impeller blade without exceeding the specific load of the un-slotted impeller blade. Hence, it can be seen from the above formulas that the axial length of an impeller also may be reduced 60%. Based on classic cascade theory, it is known that the impeller aerothermodynamic performance will be similar if the impeller blade lift and drag coefficients as well as the impeller blade chord length times the number of impeller blades are unchanged.

For the present multiphase compressor impellers 1400, the Re-number is sufficiently large and the Mach number sufficiently low to justify that the impeller blade lift and drag coefficients remain unchanged with respect to the actual range of impeller blade chord length range described above. (Given the same blade profile and arrangement of slots 1406).

It should be noted the number of blades of a conventional/reference multiphase impeller is 9. Utilization of slots 1406, however, enables increasing the number of impeller blades and correspondingly reducing the blade chord length such that the impeller performance remains effectively the same. By way of example, the impellers 1400 may be constructed with reduced axial length (Laxial) (relative to the reference 9 blade impeller) by utilizing slots 1406 and increasing the number of impeller blades 1402. The following table provides examples of the decrease in Laxial for a given increase in the number of blades 1402 having suitable arrangements of slots 1406.

| Number of Blades | Laxial (percentage of 9 blade reference impeller Laxial) |
|---|---|
| 10 | 90% |
| 11 | 82% |
| 12 | 75% |
| 13 | 69% |
| 14 | 64% |
| 15 | 60% |

Effectively, the technique described above provides an approach for reducing the specific blade load on multiphase impellers 1400 such that the impeller axial length can be reduced and more impellers 1400 can be fitted on a single shaft. In this manner, the overall or total machine head capability can be increased. By constructing the impeller blade airfoils with arrangements of slots 1406, the specific load on the impeller blades 1402 is substantially reduced. As a consequence, the blade chord length can be reduced without exceeding a maximum specific load that the operation and design of a given impeller 1400 dictates. It should be noted additional examples of impeller blades with arrangements of slots are illustrated in FIGS. 11-13.

Impeller blade slot arrangements, including multi-element airfoils, have the effect of reducing the impeller blade/airfoil suction peak and at the same time increasing the "dump" velocity of the boundary layer of the impeller blades. These effects, individually and combined, substantially lower the specific load on the impeller blades 1402. As a result, impellers 1400 may be constructed with impeller blades 1402 having comparatively shorter chord lengths without exceeding the maximum specific load that the operation and design of the impeller 1400 dictates. Consequently, the axial length of the impellers 1400 can be reduced and more impellers 1400 can be fitted to a single shaft for similar or comparable rotor dynamics, machine size, and weight constraints.

By increasing the number of stages on a single shaft for a given rotor dynamics, machine size, and weight constraints, the maximum overall or total head of the machine can be increased. As a result, turbomachines, e.g. compressors, can be constructed with multiphase impellers of substantially reduced axial length. Therefore, a greater number of impellers may be fitted to a single shaft for similar or comparable rotor dynamics, machine size, and weight constraints such that the maximum overall or total head of the turbomachine may be increased. Multiphase turbomachines may be constructed for higher maximum head.

Although a few embodiments of the system and methodology have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A subsea multiphase fluid pressure-increasing machine, comprising:

an elongated member rotatable about a longitudinal axis;

a motor system mechanically engaged to the elongated member so as to rotate the elongated member about the longitudinal axis in a rotation direction; and a plurality of impellers each impeller comprising a plurality of individual blades, each blade having a leading edge, a trailing edge, a suction side, a high pressure side, a first side connected to the elongated member, a second side, a chord length, and a chord line defined by a line between the leading and trailing edges, each impeller being fixedly mounted to the elongated member such that a chord angle of each blade is defined by an angle between the chord line and the rotation direction is less than or equal to a stall angle at which a maximum force is exerted on a multiphase fluid in a direction primarily parallel to the longitudinal axis when the elongated member is rotated in the rotation direction;

wherein each of the plurality of impellers comprises at least one unobstructed opening extending through each individual blade at a location between the leading edge and the trailing edge, such that the chord length of each blade is configured to be reduced while a pressure gradient along a streamline through the impeller is also reduced;

wherein the at least one unobstructed opening comprises a slot on the suction side and a plurality of orifices, the slot extending from the first side to the second side and defined by a bottom surface, a top surface, and a middle surface extending from the bottom surface to the top surface, the slot disposed between a first portion of the suction side and a second portion of the suction side, the first portion of the suction side extending from the trailing edge to the bottom surface, wherein the first side is partially defined by a first end of the slot and the second side of the blade is partially defined by a second end of the slot, and wherein each orifice of the plurality of orifices extends from the high pressure side to the bottom surface;

wherein the machine is configured for subsea deployment and does not experience surge induced by boundary layer separation with any positive multiphase fluid flows.

2. The machine of claim 1, wherein a product of the number of individual blades and an axial length is substantially constant regardless of the number of blades selected for each impeller.

3. The machine of claim 2, wherein the number of individual blades is at least 10.

4. The machine of claim 1, wherein at least some of the impellers are non-cylindrical in shape and the chord line is a mean chord line for the non-cylindrically shaped impellers.

5. The machine of claim 1, wherein the fluid pressure increasing machine comprises a wet gas compressor.

6. The machine of claim 1, wherein the fluid pressure increasing machine comprises a pump.

7. The machine of claim 1, wherein the at least one unobstructed opening effectively increases the stall angle of the impeller.

8. The machine of claim 1, wherein each blade comprises a second opening, wherein the second opening and the at least one unobstructed opening are spaced apart between the leading and trailing edges.

9. A subsea multiphase fluid pressure increasing machine, comprising:

an elongated member rotatable about a longitudinal axis;

a motor system mechanically engaged to the elongated member so as to rotate the elongated member about the longitudinal axis in a rotation direction; and a plurality of impellers coupled to the elongated member, each impeller comprising a plurality of individual blades, each blade comprising a leading edge, a trailing edge, a suction side, a high pressure side, a first side engaged with the elongated member, a second side, a chord length, and a chord line defined by a line between the leading and trailing edges and each impeller being mounted such that a chord angle of each blade is defined by an angle between the chord line and the rotation direction and is less than or equal to a stall angle;

wherein at least some impellers of the plurality of impellers having at least one unobstructed opening extending through each individual blade at a location between the leading edge and the trailing edge, wherein the at least one unobstructed opening comprises a slot on the suction side and a plurality of orifices, the slot extending from the first side to the second side and defined by a bottom surface, a top surface, and a middle surface extending from the bottom surface to the top surface, the slot disposed between a first portion of the suction side and a second portion of the suction side, the first portion of the suction side extending from the trailing edge to the bottom surface, wherein the first side is partially defined by a first end of the slot and the second side of the blade is partially defined by a second end of the slot, and wherein each orifice of the plurality of orifices extends from the high pressure side to the bottom surface;

wherein the machine is configured for subsea deployment and does not experience surge induced by boundary layer separation with any positive multiphase fluid flows.

10. The machine of claim 9, wherein a product of the number of individual blades and an axial length is substantially constant regardless of the number of individual blades selected for each impeller.

11. The machine of claim 10, wherein the number of individual blades is at least 12.

12. The machine of claim 10, wherein the number of individual blades is at least 15.

13. The machine of claim 9, wherein the at least one unobstructed opening through the individual blades effectively increases the stall angle at which maximum force is exerted on the multiphase fluid in a direction primarily parallel to the longitudinal axis when the elongated member is rotated in the rotation direction.

14. A method of imparting force on a multiphase fluid, comprising:

rotating an elongated member about a longitudinal axis in a rotation direction, the elongated member having fixedly mounted thereto a plurality of impellers;

providing each impeller with a plurality of individual blades, each blade having a leading edge, a trailing edge, a suction side, a high pressure side, a first side engaged with the elongated member, a second side, a chord length, and a chord line defined by a line between the leading and trailing edges, each impeller being mounted such that a chord angle of each blade is defined by an angle between the chord line and the rotation direction and is less than or equal to a stall angle at which a maximum force is exerted on the multiphase fluid in a direction primarily parallel to the longitudinal axis; and arranging at least one unobstructed opening through each individual blade at a location between the leading edge and the trailing edge, wherein the at least one unobstructed opening comprises a slot on the suction side and a plurality of orifices, the slot extending from the first side to the second side and defined by a bottom surface, a top surface, and a middle surface extending from the bottom surface to the top surface, the slot disposed between a first portion of the suction side and a second portion of the suction side, the first portion of the suction side extending from the trailing edge to the bottom surface, wherein the first side is partially defined by a first end of the slot and the second side of the blade is partially defined by a second end of the slot, and wherein each orifice of the plurality of orifices extends from the high pressure side to the bottom surface;

wherein the impellers are configured for subsea deployment and do not experience surge induced by boundary layer separation with any positive multiphase fluid flows.

15. The method of claim 14, further comprising structuring the at least one unobstructed opening so that a product of the number of individual blades and an axial length remains substantially constant regardless of the number of individual blades selected for each impeller.

16. The method of claim 15, wherein structuring comprises reducing the axial length of each individual impeller to 75% or less of a reference impeller having 9 impeller blades without reducing a performance of each impeller relative to the reference impeller.

17. The method of claim 15, wherein structuring comprises using at least 12 individual blades on each impeller.

* * * * *